US008678795B2

(12) United States Patent
White, Jr.

(10) Patent No.: US 8,678,795 B2
(45) Date of Patent: Mar. 25, 2014

(54) STATOR OF A GEROTOR DEVICE AND A METHOD FOR MANUFACTURING ROLLER POCKETS IN A STATOR OF A GEROTOR DEVICE

(75) Inventor: Hollis N. White, Jr., Hopkinsville, KY (US)

(73) Assignee: White Drive Products, Inc., Hopkinsville, KY (US)

( * ) Notice: Subject to any disclaimer, the term of this patent is extended or adjusted under 35 U.S.C. 154(b) by 376 days.

(21) Appl. No.: 13/193,946

(22) Filed: Jul. 29, 2011

(65) Prior Publication Data

US 2013/0028778 A1 Jan. 31, 2013

(51) Int. Cl.

| | |
|---|---|
| ***F03C 2/00*** | (2006.01) |
| ***F03C 4/00*** | (2006.01) |
| ***F04C 15/00*** | (2006.01) |
| ***F04C 2/00*** | (2006.01) |

(52) U.S. Cl.
USPC ..... 418/1; 418/61.3; 418/178; 418/179; 451/51

(58) Field of Classification Search
USPC ..... 418/1, 61.3, 178–179; 451/47, 51, 52, 451/61, 147, 487, 900
See application file for complete search history.

(56) References Cited

U.S. PATENT DOCUMENTS

| | | | | |
|---|---|---|---|---|
| 3,438,156 | A | | 4/1969 | Lasko |
| 3,563,679 | A | | 2/1971 | Richardson |
| 3,591,320 | A | | 7/1971 | Woodling |
| 3,915,603 | A | * | 10/1975 | Swedberg ..... 418/61.3 |
| 3,930,766 | A | | 1/1976 | Swedberg |
| 4,008,015 | A | | 2/1977 | McDermott |
| 4,058,938 | A | | 11/1977 | Harle |
| 4,087,215 | A | | 5/1978 | Miller |
| 4,170,851 | A | | 10/1979 | Enos |
| 4,592,173 | A | | 6/1986 | White |
| 4,859,160 | A | | 8/1989 | White |
| 5,030,072 | A | | 7/1991 | Wenker |
| 5,595,479 | A | | 1/1997 | Hansen et al. |
| 7,431,635 | B2 | | 10/2008 | Dong et al. |
| 7,481,633 | B2 | | 1/2009 | White |
| 7,726,958 | B2 | | 6/2010 | Pedersen et al. |
| 8,221,102 | B2 | | 7/2012 | Pedersen et al. |

FOREIGN PATENT DOCUMENTS

| | | |
|---|---|---|
| WO | 2012/058527 | 5/2012 |

OTHER PUBLICATIONS

International Search Report dated Aug. 27, 2012, filed in PCT/US2012/040835.

* cited by examiner

*Primary Examiner* — Theresa Trieu
(74) *Attorney, Agent, or Firm* — Rankin, Hill & Clark LLP

(57) ABSTRACT

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. Each roller pocket defines a generally cylindrical roller pocket bearing surface. The method further includes grinding each roller pocket bearing surface of each roller pocket with a grinding wheel rotating about a rotational axis perpendicular to the central axis. A stator for a gerotor device is also described.

17 Claims, 3 Drawing Sheets

STATOR OF A GEROTOR DEVICE AND A METHOD FOR MANUFACTURING ROLLER POCKETS IN A STATOR OF A GEROTOR DEVICE

BACKGROUND

A hydraulic gerotor device includes a stator having internal teeth and a rotor having external teeth. The rotor is mounted eccentrically within the stator. There is one more internal tooth on the stator than external teeth on the stator. The internal teeth of the stator can be formed by cylindrical rollers, which reduce wear in the gerotor device between the rotor and the stator.

The cylindrical rollers fit into roller pockets found in the stator. It is known to form these pockets by broaching. A great degree of precision is needed in the final inside diameter of the roller pockets, and it is also desirable to harden the inside diameter of each roller pocket since the inside diameter acts as a bearing surface for the cylindrical rollers. Typically, the internal bearing surface of each roller pocket covers an arc of 180° around the respective roller received therein.

It is also known to hone the roller pockets in a stator. A plurality of similar individual tapered abrasive hones are passed through roller pockets cut into a stator. The hones have outer frusto-conical surfaces and rotate about an axis parallel with a central axis of the stator. The honing process produces adequate results; however, honing requires a highly skilled machine operator.

SUMMARY

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. Each roller pocket defines a generally cylindrical roller pocket bearing surface. The method further includes grinding a first section of the roller pocket bearing surface of each roller pocket with a grinding wheel rotating about a rotational axis perpendicular to the central axis while a second section of the roller pocket bearing surface is not in contact with the grinding wheel. The first section is located on a first side of a center line of the roller pocket and the second section is located on a second, opposite, side of the center line. The method further includes grinding the second section of the roller pocket bearing surface of each roller pocket with the grinding wheel rotating about a rotational axis perpendicular to the central axis while the first section of the roller pocket bearing surface is not in contact with the grinding wheel.

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. The method further includes grinding a generally cylindrical roller pocket bearing surface, which defines a generally circular arc greater than about 185 degrees, of a respective roller pocket with a grinding wheel rotating about a rotational axis perpendicular to the central axis.

A method for manufacturing roller pockets in a stator of a gerotor device generally includes providing a stator having a cavity including a generally cylindrical section defining a central axis and a plurality of roller pockets angularly spaced around a periphery of the cylindrical section. Each roller pocket is configured to receive a respective roller, which acts as an internal tooth of the gerotor device. Each roller pocket defines a generally cylindrical roller pocket bearing surface and a center line that intersects the central axis. The method further includes grinding the roller pocket bearing surface of a respective roller pocket with a grinding wheel rotating about a rotational axis perpendicular to the central axis. A plane that is normal to the rotational axis of the grinding wheel is offset at an angle $\phi$ with respect to center line. The angle $\phi$ is greater than 0°.

A stator for a gerotor device includes a plurality of rollers and a stator body having a forward face, a rear face, a cavity including a generally cylindrical section defining a central axis and a plurality of roller pockets angularly spaced around a periphery of the cylindrical section. Each roller pocket receives a respective roller, which acts as an internal tooth of the stator. Each roller pocket includes a generally cylindrical roller pocket bearing surface, against which the respective roller received in the roller pocket bears. The roller pocket bearing surface extends along an arc that partially surrounds the respective roller received in the respective roller pocket, and the arc is greater than 185°. Each bearing surface is a ground surface ground by a grinding wheel rotating in a rotational axis that is perpendicular to the central axis of the stator.

DETAILED DESCRIPTION

Figure 1:
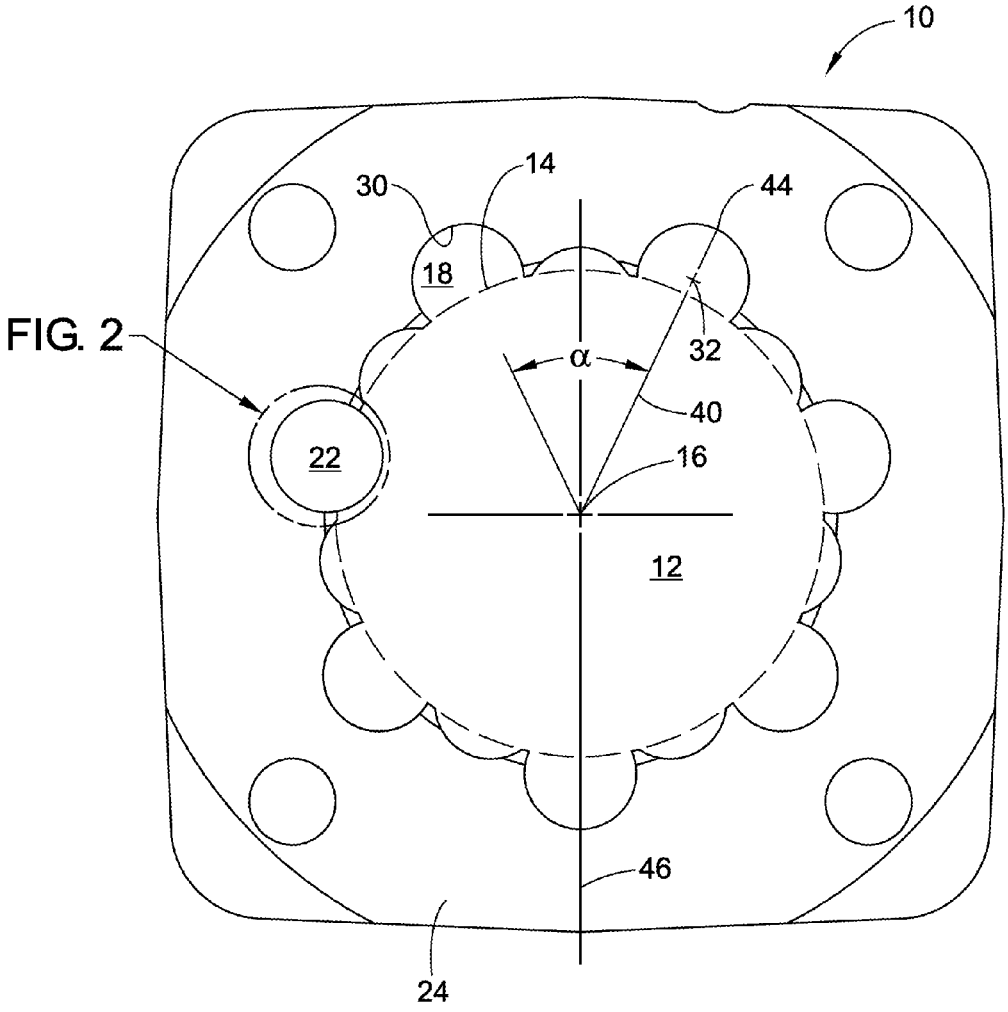
FIG. 1 is a diagrammatic view of a stator for a gerotor device. Only one roller is shown received a respective roller pocket of the stator depicted in FIG. 1.

The descriptions and drawings herein are merely illustrative and are provided so that one of ordinary skill in the art can make and use a gerotor device described herein. Various modifications and alterations can be make in the structures and steps disclosed without departing from the scope of the invention, which is defined by the appended claims. Various identified components of a gerotor device disclosed herein are merely terms of art that may vary from one manufacturer to another. The terms should not been deemed to limit the invention. The drawings are shown for purposes of illustrating one or more exemplary embodiments and not are for purposes of limiting the appended claims. All references to direction and position, unless otherwise indicated, refer to the orientation of the components illustrated in the drawings and are not to be construed as limiting the appended claims.

FIG. 1 shows a stator 10 of a hydraulic gerotor device. The stator 10 includes a stator body provided with a cavity 12 including a generally cylindrical section (depicted by dashed circle 14 in FIG. 1) defining a central axis 16 of the stator and a plurality of roller pockets 18 around a periphery of the cylindrical section. Each roller pocket 18 is configured to receive a respective roller 22 (only one roller is shown in FIG. 1). Each roller 22 acts as an internal tooth of the gerotor device. The roller pockets 18 are angularly spaced from one another around the periphery of the cavity 12. As depicted, each roller pocket 18 is angularly spaced from adjacent roller pockets by an angle α.

The stator 10 acts as an internally-toothed member that eccentrically receives an externally-toothed rotor (not shown). The rotor is known in the gerotor arts. The rotor has one less external tooth than the internal teeth of the stator 10 to define a number of fluid pockets, which expand and contract upon the rotor's orbital and rotational movement within the stator. The stator 10 includes a forward face 24 and a rear face (not visible in FIG. 1) opposite the forward face. Each of the forward face 24 and the rear face are generally planer and normal to the central axis 16 of the stator 10 to promote a fluid tight seal with other components of a machine that includes the gerotor device.

Each roller pocket 18 includes a generally cylindrical roller pocket bearing surface 30. The respective roller 22 received in the roller pocket 18 bears against roller pocket bearing surface 30. Each roller pocket bearing surface 30 extends along an arc depicted in FIG. 2 by angle θ. The arc, and thus the bearing surface 30, partially surrounds the respective roller 22 received in the roller pocket 18. The arc, as represented by the angle θ in FIG. 2, can be greater than about 175° with respect to a nominal center point 32 of the respective roller pocket 18. More particularly, each bearing surface 30 can extend along an arc greater than 185° or 190° with respect to the nominal center point 32 of the respective roller pocket 18. Even more particularly, each bearing surface 30 can extend along an arc between about 185° and about 220° with respect to the nominal center point 32 of the respective roller pocket 18. Extending the arc of the bearing surface 30 beyond 180° provides a circumferentially longer bearing surface for the roller 22 as compared to known stators. A larger bearing surface provides an advantage in that a smaller diameter roller is able to withstand greater pressures because the pressure exerted on the roller 22 by the rotor is distributed across a greater surface area, as compared to a roller that is received in a typical roller pocket, which extends along an arc of 180°.

Each roller pocket bearing surface 30 follows a generally constant radius r but for an undercut or notch 34 (FIG. 2) formed in each in each roller pocket 18. Each roller pocket bearing surface 30 includes a first section 36 that is disposed on a first side of the undercut 34 and a second section 38 disposed on a second side, which is opposite the first side, of the undercut. The first section 36 and the second section 38 follow the radius r, which is also substantially the same as the radius of each roller 22 received in the pocket 18. The undercut 36 is where the bearing surface 30 deviates from the radius of the remainder of the bearing surface outside of the undercut. The undercut 34 can be very small, e.g. a 0.0002 inches gap is provided between the bearing surface 30 at the undercut 34 and the roller 22. In the illustrated embodiment, the undercut 34 is centered with respect to the roller pocket 18.

Each roller pocket 18 defines a center line 40 which intersects the nominal center point 32 (the nominal center point is coincident with the axis of rotation of the roller 22) of each roller pocket 18 and the central axis 16 of the stator 10. The radius r emanates from the nominal center point 32 to the first section 36 and the second section 38 of the bearing surface 30. The first section 36 of the bearing surface 30 is located on a first side of the center line 40 of the respective roller pocket and the second section 38 is located on a second, opposite, side of the center line. For the embodiment shown in FIG. 2, where the center line 40 of the pocket 18 intersects the bearing surface 30 at a 12:00 o'clock position, the first section 36 extends along an arc to at least a 9:00 o'clock position and the second section 38 extends along an arc to at least a 3:00 o'clock position.

The cavity 12 in the stator 10 is symmetrical with respect to a plurality of symmetrical axes 46. Only one symmetrical axis 46 is shown in FIG. 1. Each symmetrical axis 46 intersects the nominal center point 32 of each roller pocket 22 and the central axis 16. The undercut 34 can be centered with respect to the center line 40, i.e. the undercut 34 can terminate and thus transition into the first section 36 and the second section 38, respectively, equidistant from where the center line 40 intersects the bearing surface 30. The intersection of the center line 40 and the bearing surface 30 is depicted at 44 in FIG. 1.

Figure 3:
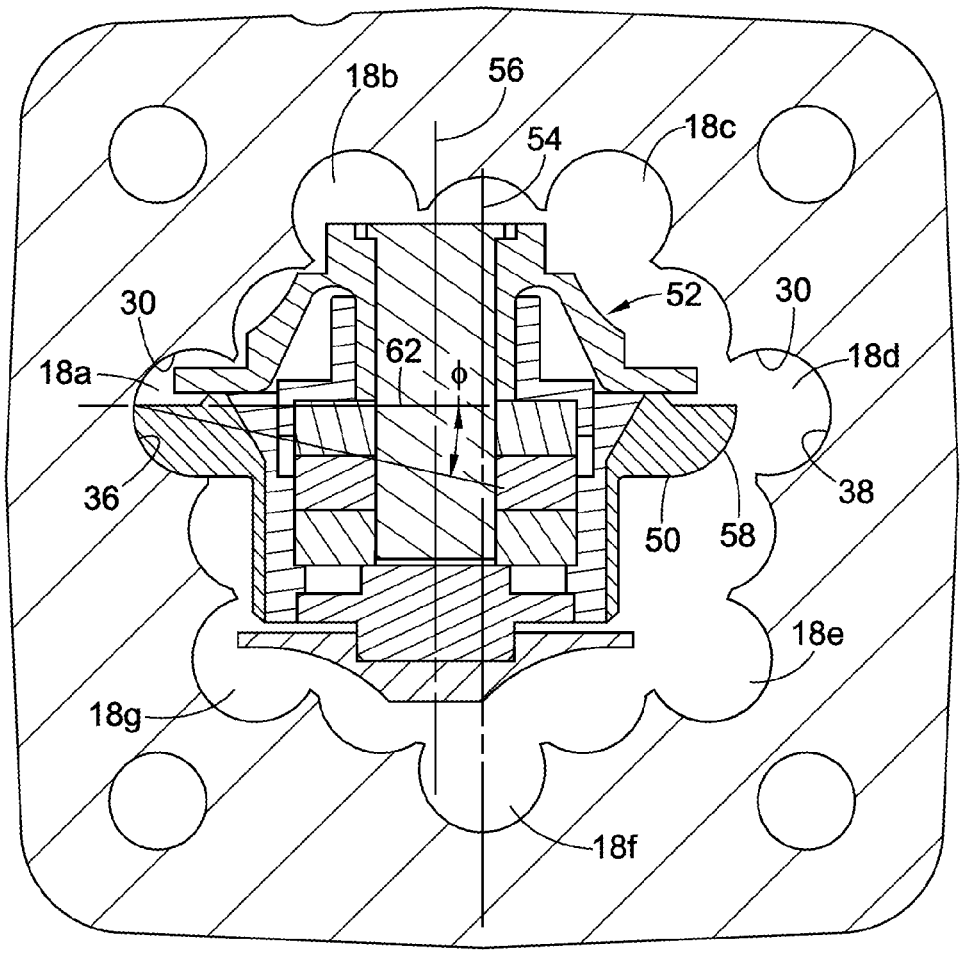
FIG. 3 is a sectional view of the stator shown in FIG. 1 and a grinding wheel assembly grinding a roller pocket in the stator.

With reference to FIG. 3, each roller pocket bearing surface 30 is ground with a grinding wheel 50 of a grinding wheel assembly 52. The grinding wheel assembly 52 includes a spindle 54 to which the grinding wheel 50 is connected. The spindle 54 defines a rotational axis 56 about which both the spindle and the grinding wheel 50 rotate. The grinding wheel 50 includes a contact surface 58, which in cross section taken normal to the central axis 16 of the stator 10, follows the radius r of the roller pocket bearing surface 30. The grinding wheel 50 rotates, generally, in a plane normal to the central axis 16 of the stator 10. When grinding a respective roller bearing surface 30, the grinding wheel assembly 52 moves with respect to the stator 10 in an axial direction, which is parallel to the central axis 16 of the stator.

As shown in FIG. 3, the contact surface 58 of the grinding wheel 50 follows an arc that is substantially less than 180°. Because of this configuration, each bearing surface 30 of each roller pocket 18 is ground at least twice. FIG. 3 depicts the stator 10 including roller pockets 18*a*-18*g*. A fewer or greater number of roller pockets can be provided. Where the center point 44 on the bearing surface 30 is at the 12:00 o'clock position, the grinding wheel 50 can grind the first section 36 of each bearing surface 30 between about the 12:00 o'clock to about the 8:00 o'clock position. By indexing the stator 10 with respect the grinding wheel 50, or vice versa, the second section 38 of each bearing surface 30 can be ground between about the 12:00 o'clock position to about the 4:00 o'clock position. Accordingly, grinding the bearing surface 30 of a respective roller pocket, e.g. pocket 18*a*, includes grinding the first section 36 of the bearing surface 30 of the respective roller pocket 18*a* while the second section 38 and the notch 34 of the respective bearing surface are not in contact with the grinding wheel 50. Grinding the bearing surface 30 of the roller pocket 18*a* further includes grinding the second section 38 of the bearing surface of the roller pocket while the first section 36 and the notch 34 of the respective bearing surface is not in contact with the grinding wheel 50. This prolongs the life of the grinding wheel 50, which is discussed below. The stator 10 is indexed with respect to the grinding wheel 50, or vice versa, after the first section 36 is ground and before the second section 38 is ground, or vice versa.

FIG. 3 depicts the grinding of the first section 36 of the bearing surface 30 of the roller pocket 18*a*. To grind the second section 38 of the bearing surface 30 of the roller pocket 18*a*, the stator 10 is indexed with respect to the grinding wheel 50, or vice versa. After grinding the first section 36 of the bearing surface 30 of the roller pocket 18*a*, the grinding wheel 50 can be moved, or translated, with respect to the stator 10, or vice versa, in a direction perpendicular to the symmetrical axis 46, which is parallel to the rotational axis 56 of the grinding wheel 50. Per the orientation shown in FIG. 3, after grinding the first section 36 of the bearing surface 30 of the roller pocket 18*a*, the grinding wheel 50 is moved with respect to the stator 10, or vice versa, such that the grinding wheel 50 contacts the second section 38 of the bearing surface 30 of roller pocket 18*d*. As such, a single indexing of the stator 10 with respect to the grinding wheel 50, or vice versa, allows two different pockets, i.e. pockets 18*a* and 18*d*, to both be ground. If desired, the diameter of the grinding wheel 50 can be increased or the dimensions of the cavity 12 can be decreased, such that the grinding of the first section 36 of the bearing surface 30 for the roller pocket 18*a* and the grinding of the second section 38 of the bearing surface 30 of the roller pocket 18*d* can be performed simultaneously.

After grinding the second section 38 of the bearing surface 30 of the roller pocket 18*d*, the stator 10 is indexed with respect to the grinding wheel 50, or vice versa, the angle $\alpha$about the central axis 16 of the stator. Indexing the grinding wheel 50 with respect to the stator 10 in the clockwise direction (per the orientation shown in FIG. 3) allows for the grinding of the first section 36 of the bearing surface 30 for the roller pocket 18*b* and the grinding of the second section 38 of the bearing surface 30 for the roller pocket 18*e*. The steps of grinding the first section of the bearing surface of a roller pocket located on a first side of the respective symmetrical axis of the stator and grinding a second section of the bearing surface of another roller pocket, which is located on an opposite side of the respective symmetrical axis, can be repeated until each roller pocket has been ground in both the first and the second sections. This allows for a single indexing for the grinding of two roller pockets.

Figure 2:
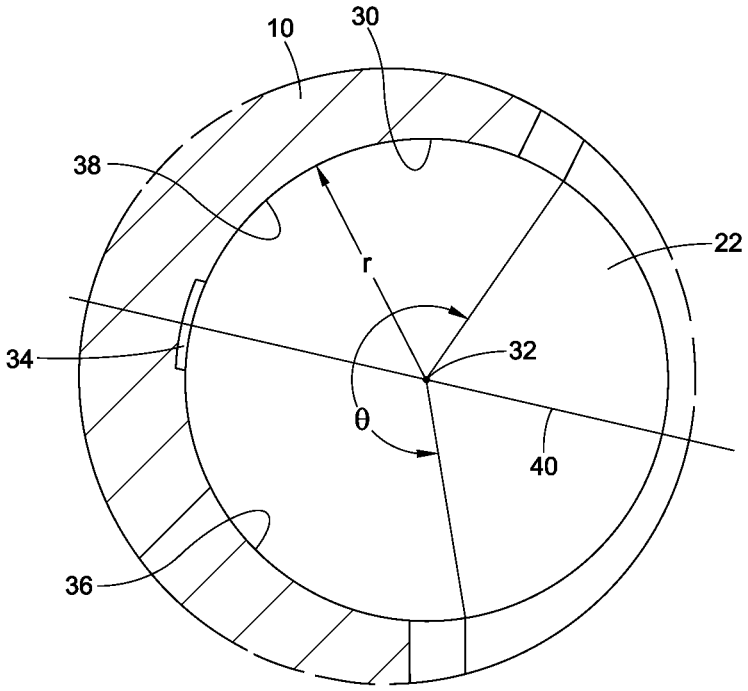
FIG. 2 is an enlarged view of a portion of FIG. 1.

The undercut 34, which is depicted in FIG. 2, is not visible in FIG. 3. However, each of the roller pockets 18*a*-18*g* can include such an undercut 34 where the bearing surface deviates from the radius r of the remainder of the bearing surface. The undercut 34 can be centered with respect to the center point 44 on the bearing surface 30 of each roller pocket.

By providing the undercut 34, a relief is provided for the grinding wheel 50. A truer indexing of the stator 10 with respect to the grinding wheel 50 is manageable because of the undercuts 34 provided, in each respective roller pocket 18. In the illustrated embodiment, the grinding wheel 50 is a CBN grinding wheel. Regrinding of a surface that is already been ground with a CBN grinder can lead to dulling of the grinding wheel. The undercuts 34 and the bearing surfaces 30 of each roller pocket 18*a*-18*g* offsets the contact surface 58 of the grinding wheel 50 from the bearing surface 30 so that the area of each bearing surface 30 around the 12:00 o'clock position is not ground. This increases the life of the grinding wheel. The undercut 34 also allows hydraulic fluid to enter into the space between the roller pocket bearing surface 30 and the roller 22 to provide lubrication for the rollers and to provide hydrostatic pressure to counteract forces being applied on the roller bearing surface as the rotor acts against the rollers.

With reference to FIG. 3, a plane 62 that is normal to the rotational axis 56 of the grinding wheel 50 is angularly offset at an angle $\phi$ with respect to the center line 40, which intersects the nominal center point 32 of the respective roller pocket 18 that is being ground and the central axis 16 of the stator 10. The angle $\phi$ is greater than zero. Contact of the contact surface 58 of the grinding wheel 50 with the bearing surface 30 is more in line with the pressure angle exerted by the rotor on the roller 22 as compared to the bearing surfaces that are honed using the prior art method.

A method for manufacturing roller pockets in a stator of a gerotor device and a stator for a gerotor device have been described above with particularity. Modifications and alterations will occur to those upon reading and understanding, the preceding detailed description. The invention, however, is not limited to only the embodiments described above. Instead, the invention is broadly defined by the appended claims and the equivalents thereof.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface;

grinding a first section of the roller pocket bearing surface of each roller pocket with a grinding wheel rotating about a rotational axis perpendicular to the central axis while a second section of the roller pocket bearing surface is not in contact with the grinding wheel, wherein the first section is located on a first side of a center line of the roller pocket and the second section is located on a second, opposite, side of the center line; and grinding the second section of the roller pocket bearing surface of each roller pocket with the grinding wheel rotating about a rotational axis perpendicular to the central axis while the first section of the roller pocket bearing surface is not in contact with the grinding wheel.

2. The method of claim 1, wherein the center line of the pocket intersects the bearing surface at a 12:00 o'clock position, the first section extends along an arc to at least a 9:00 o'clock position and the second section extends along an arc to at least a 3:00 o'clock position.

3. The method of claim 1, wherein a plane that is normal to the rotational axis of the grinding wheel is offset at an angle $\phi$ with respect to the center line while grinding the first section and the second section, wherein the angle $\phi$ is greater than 0°.

4. The method of claim 1, wherein grinding a first section of the bearing surface includes grinding a first section of the bearing surface of a first roller pocket located on a first side of a symmetrical axis of the stator;

wherein grinding a second section of the bearing surface includes grinding a second section of the bearing surface of a second roller pocket located on a, second, opposite side of the symmetrical axis of the stator; and the method further comprising moving at least one of the stator and the grinding wheel with respect to the other of the stator and the grinding wheel in a direction perpendicular to the symmetrical axis of the stator after grinding the first section of the bearing surface of the first roller pocket.

5. The method of claim 4, wherein grinding a first section of the bearing surface includes grinding a first section of the bearing surface of a first roller pocket located on a first side of a symmetrical axis of the stator;

wherein grinding a second section of the bearing surface includes grinding the second section of the bearing surface of a second roller pocket located on a, second, opposite side of the symmetrical axis of the stator;

wherein grinding the first section of the bearing surface of the first roller pocket and grinding the second section of the bearing surface of the second roller pocket are performed simultaneously.

6. The method of claim 1, wherein providing the stator further includes providing the stator wherein each roller pocket includes an undercut where the respective bearing surface deviates from a radius of a remainder of the bearing surface outside of the undercut;

wherein grinding a first section of the roller pocket bearing surface of each roller pocket with a grinding wheel includes grinding the first section of the roller pocket bearing surface of each roller pocket while a second section and the undercut of the roller pocket bearing surface is not in contact with the grinding wheel.

7. The method of claim 6, further comprising:

indexing at least one of the stator and the grinding wheel with respect to the other of the stator and the grinding wheel;

wherein grinding the second section of the roller pocket bearing surface of each roller pocket with the grinding wheel includes grinding the second section of the roller pocket bearing surface of each roller pocket while the first section and the undercut of the roller pocket bearing surface is not in contact with the grinding wheel.

8. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface extending along an arc greater than about 185°; and grinding the roller pocket bearing surface of a respective roller pocket with a grinding wheel rotating about a rotational axis perpendicular to the central axis.

9. The method of claim 8, wherein grinding the bearing surface of a respective roller pocket further includes grinding a first section of the bearing surface of the respective roller pocket while a second section of the respective bearing surface is not in contact with the grinding wheel.

10. The method of claim 9, further comprising:

indexing at least one of the stator and the grinding wheel with respect to the other of the stator and the grinding wheel;

wherein grinding the bearing surface of a respective roller pocket further includes grinding the second section of the bearing surface of the respective roller pocket while the first section of the respective bearing surface is not in contact with the grinding wheel.

11. The method of claim 8, wherein grinding the bearing surface of a respective roller pocket further includes:

grinding a first section of the bearing surface of a first roller pocket located on a first side of a symmetrical axis of the stator while a second section of the bearing surface of the first roller pocket is not in contact with the grinding wheel; and grinding a second section of the bearing surface of a second roller pocket located on a second, opposite side of the symmetrical axis of the stator, while a first section of the bearing surface of the second roller pocket is not in contact with the grinding wheel.

12. The method of claim 11, further comprising:

moving at least one of the stator and the grinding wheel with respect to the other of the stator and the grinding wheel in a direction perpendicular to the a symmetrical axis of the stator after grinding the first roller pocket.

13. The method of claim 11, wherein grinding the first section of the bearing surface of the first roller pocket and grinding the second section of the bearing surface of the second roller pocket are performed simultaneously.

14. The method of claim 8, wherein providing the stator further includes providing the stator wherein each roller pocket includes an undercut where the respective bearing surface deviates from a radius of a remainder of the bearing surface outside of the undercut, and wherein grinding the bearing surface of a respective roller pocket further includes grinding a first section of the bearing surface of the respective roller pocket while a second section of the respective bearing surface and the respective undercut is not in contact with the grinding wheel.

15. The method of claim 14, further comprising:

indexing at least one of the stator and the grinding wheel with respect to the other of the stator and the grinding wheel;

wherein grinding the bearing surface of a respective roller pocket further includes grinding the second section of the bearing surface of the respective roller pocket while the first section of the respective bearing surface and the respective undercut is not in contact with the grinding wheel.

16. The method of claim 8, wherein while grinding the bearing surface of the respective roller pocket, a plane that is normal to the rotational axis of the grinding wheel is offset at an angle $\phi$ with respect to a line intersecting a nominal center point of the respective roller pocket and the central axis, wherein the angle $\phi$ is greater than 0°.

17. A method for manufacturing roller pockets in a stator of a gerotor device, the method comprising:

providing a stator having a cavity including a generally cylindrical section defining a central axis and a plurality of roller pockets angularly spaced around a periphery of the cylindrical section, wherein each roller pocket is configured to receive a respective roller, which acts as an internal tooth of the gerotor device, wherein each roller pocket defines a generally cylindrical roller pocket bearing surface extending along an arc greater than about 185°, wherein each roller pocket includes an undercut where the respective bearing surface deviates from a remainder of the bearing surface outside of the undercut; and grinding a first section of the roller pocket bearing surface of a respective roller pocket with a grinding wheel rotating about a rotational axis perpendicular to the central axis while a second section of the respective bearing surface and the respective undercut is not in contact with the grinding wheel.

* * * * *